US012324464B2

(12) United States Patent
Nachawati

(10) Patent No.: US 12,324,464 B2
(45) Date of Patent: Jun. 10, 2025

(54) ACTIVEWEAR GARMENT

(71) Applicant: Zana Nachawati, Dallas, TX (US)

(72) Inventor: Zana Nachawati, Dallas, TX (US)

( * ) Notice: Subject to any disclaimer, the term of this patent is extended or adjusted under 35 U.S.C. 154(b) by 0 days.

(21) Appl. No.: 18/411,998

(22) Filed: Jan. 12, 2024

(65) Prior Publication Data

US 2024/0148085 A1 May 9, 2024

Related U.S. Application Data

(63) Continuation of application No. 17/840,425, filed on Jun. 14, 2022, now Pat. No. 11,910,848, which is a continuation of application No. 16/184,652, filed on Nov. 8, 2018, now Pat. No. 11,388,937.

(51) Int. Cl.

| | |
|---|---|
| ***A41D 1/04*** | (2006.01) |
| ***A41D 1/22*** | (2018.01) |
| ***A41D 31/02*** | (2019.01) |
| ***A63B 71/10*** | (2006.01) |

(52) U.S. Cl.

CPC ..... *A41D 1/04* (2013.01); *A41D 1/22* (2013.01); *A41D 31/02* (2013.01); *A63B 71/10* (2013.01); *A41D 2200/20* (2013.01); *A41D 2300/22* (2013.01); *A41D 2400/82* (2013.01)

(58) Field of Classification Search

CPC ..... A63B 71/10; A62B 17/04; A41D 13/116; A41D 13/1218; A61M 16/0688

USPC ..... 2/84, 202; 351/155

See application file for complete search history.

(56) References Cited

U.S. PATENT DOCUMENTS

| | | | | | |
|---|---|---|---|---|---|
| 2,192,080 | A * | 2/1940 | Hock | A42B 1/12 | 2/68 |
| 2,581,366 | A * | 1/1952 | De Grazia | A42B 1/045 | 2/84 |
| 2,685,091 | A * | 8/1954 | Thill | A42B 1/045 | D2/879 |
| 3,789,428 | A * | 2/1974 | Martin | A63B 71/10 | 2/9 |

(Continued)

FOREIGN PATENT DOCUMENTS

| | | | | |
|---|---|---|---|---|
| DE | 2700703 | A1 * | 12/1978 | A42B 1/046 |
| JP | 2006296817 | A * | 11/2006 | A63B 71/10 |

(Continued)

OTHER PUBLICATIONS

"'The Five W's' of Velcro Brand." Gleicher. Dec. 9, 2022. https://www.gleicher.com/blog/the-five-ws-of-velcro-brand-molded-woven-and-knitted-fasteners (Year: 2022).*

(Continued)

*Primary Examiner* — Grace Huang

(57) ABSTRACT

An activewear garment having facial opening formed on an anterior side of an upper head portion of the garment. An elongate elastic member is attached to the upper head portion. The elongate elastic member includes a top portion and a bottom portion, each portion having a first end and a second end. There are first and second gaps between the respective ends of the top portion and bottom portion of the elongate elastic member to facilitate the insertion and removal of items intended for insertion in or on a user's ears such as, for example, ear pods and athletic glasses. The elongate elastic member can be constructed of woven fabric, braided fabric, and/or knitted fabric.

14 Claims, 5 Drawing Sheets

(56) References Cited

U.S. PATENT DOCUMENTS

| | | | | |
|---|---|---|---|---|
| 3,793,110 | A | 2/1974 | Saunders | |
| 4,823,407 | A | 4/1989 | Phillips | |
| 5,136,470 | A * | 8/1992 | Sheridon | H05K 3/0061 361/792 |
| 6,920,644 | B1 * | 7/2005 | Higgs | A42B 1/22 2/195.3 |
| 7,017,577 | B2 | 3/2006 | Matich | |
| 8,631,516 | B2 | 1/2014 | Hoffman | |
| 9,138,025 | B1 | 9/2015 | Lunsford | |
| 9,648,914 | B2 | 5/2017 | Duncan | |
| 10,143,249 | B2 * | 12/2018 | West | A41D 3/00 |
| 10,952,483 | B2 * | 3/2021 | Thomas | A42B 7/00 |
| 11,247,079 | B2 * | 2/2022 | Walker | A41D 13/1138 |
| 11,388,937 | B2 * | 7/2022 | Nachawati | A63B 71/10 |
| 11,910,848 | B2 * | 2/2024 | Nachawati | A63B 71/10 |
| 2005/0217004 | A1 | 10/2005 | Haberfeld | |
| 2010/0210177 | A1 | 8/2010 | Shanahan | |
| 2010/0286791 | A1 * | 11/2010 | Goldsmith | A61B 17/12022 604/524 |
| 2011/0225699 | A1 | 9/2011 | Elhamsadat | |
| 2013/0247275 | A1 | 9/2013 | Javad | |
| 2014/0190476 | A1 | 7/2014 | Stinton | |
| 2015/0208747 | A1 | 7/2015 | Barrett | |
| 2017/0361054 | A1 * | 12/2017 | Day | A42B 1/048 |
| 2018/0352882 | A1 * | 12/2018 | Bazzy | A42B 5/00 |
| 2021/0145096 | A1 * | 5/2021 | Thornton | A41D 1/06 |

FOREIGN PATENT DOCUMENTS

| | | | | |
|---|---|---|---|---|
| KR | 800000402 | B1 * | 5/1980 | |
| WO | WO-2021232115 | A1 * | 11/2021 | A41D 13/02 |

OTHER PUBLICATIONS

International Search Report and Written Opinion for International Patent No. PCT/US2019/060136 filed Nov. 6, 2019; 8 pgs.

* cited by examiner

ACTIVEWEAR GARMENT

BACKGROUND OF THE INVENTION

Technical Field

The present invention relates generally to garments and, more specifically, to an activewear garment having anterior facial opening with an elastic securing band attached to an interior rim of said facial opening, and having an adhering layer applied to such securing band and adapted to releasably adhere to a user's facial skin, thereby preventing the whole or partial dislodgement of such activewear garment during high contact athletic activities.

Description of Related Art

There are an enormous multitude of female athletes who desire to participate in high contact sports who simultaneously desire to cover their hair while participating in such sports. Some female athletes choose to cover their hair and other portions of their heads for religious reasons and as described further below, also for safety and athletic performance reasons. In many high contact sports, such as those involving ground fighting or grappling, the types of head coverings that may be typically worn by female athletes in daily life, would be inadequate. Such head coverings would be incapable of remaining on the athlete's head during intense fighting, which often involves the pulling of clothing and the use of submission holds around the athlete's head that would cause the head covering to become dislodged. For such female athletes, having no suitable types of activewear garments to wear during high contact sport activities leaves them with the less than desirable options of not participating in high contact sports at all, or alternatively, wearing garments with head coverings that their hair, and possibly other parts of their heads and necks, will be exposed during public sporting activities. Given such options, many female athletes simply choose not to participate in high contact sporting activities.

Another common reason for female athletes to cover their hair during sporting activities is that exposed hair may pose an increased safety risk to the athlete and may inhibit their performance. In some sports, such as the fighting sports mentioned above, hair may be intentionally or inadvertently pulled during fighting. In other sports, such as gymnastics, there is a possibility that hair may become entangled in equipment (rings, high bars, etc.). In certain water sports such as, for example, water polo, exposed hair may reduce the athlete's ability to see. In all such scenarios, it may be highly desirable for an athlete to wear an activewear garment flexible enough to provide the athlete with a full range of movement, while also preventing the hair from being exposed due to contact with other athletes or from contact with athletic equipment.

While activewear garments with head coverings are known in the prior art, such prior art activewear garments have several drawbacks. One drawback is that such prior art activewear garments do not include means for effectively securing a head covering portion of the garment to a user's head. While some prior art activewear garments may incorporate stretchable fabrics to some degree, the head covering portions of such garments may be easily dislodged during high contact athletic events. Thus, for wearers of such prior art garments who desire to avoid unwanted exposure, but who seek to fully participate and excel in high contact athletic events, the ability of such prior art garments to remain adequately secured to the user's head is simply unsatisfactory.

Therefore, what is needed is an activewear garment having a high-resistance elastic securing band attached to the interior rim of a garment's facial opening to enhance the ability of the garment to be secured to a user's head. What is also needed is an activewear garment with a facial extension such that the facial opening, at least on upper portions of the user's face, may be worn below the user's hairline and along substantially vertical portions of the user's forehead, thereby reducing the ability of the securing band to slip. What is also needed is an adhering layer composed of an adhering substance, applied on or embedded within the interior side of the securing band, increasing the ability of the securing band to adhere to the user's facial skin. The activewear garment described herein satisfies these needs and others as will become apparent to one of ordinary skill after a careful study of the detailed description of the embodiments set forth below.

BRIEF DESCRIPTION OF THE SEVERAL VIEWS OF THE DRAWINGS

The present invention will be more fully understood by reference to the following detailed description of the preferred embodiments of the present invention when read in conjunction with the accompanying drawings, wherein.

Figure 1:
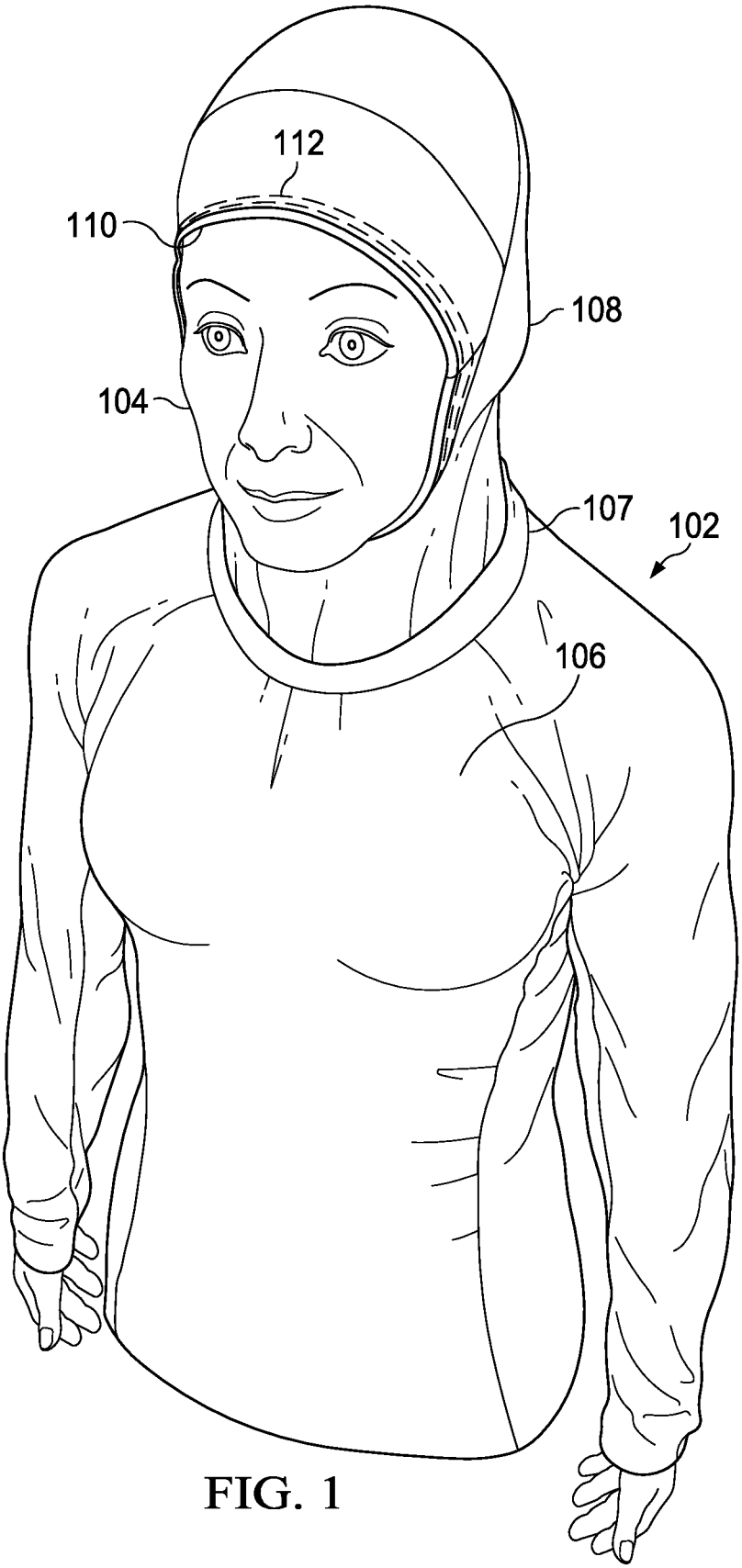
FIG. 1 is a perspective view of an embodiment of the activewear garment worn by a user.

The above figures are provided for the purpose of illustration and description only, and are not intended to define the limits of the disclosed invention. Use of the same reference number in multiple figures is intended to designate the same or similar parts. Furthermore, if and when the terms "top," "bottom," "anterior," "posterior," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION OF THE INVENTION

Several exemplary embodiments of the claimed invention(s) will now be described with reference to the drawings. Unless otherwise noted, like elements will be identified by identical numbers throughout all figures. The invention(s) illustratively disclosed herein suitably may be practiced in the absence of any element that is not specifically disclosed herein.

Activewear garments for maximizing the capability of the garment to be secured to a user's head, while minimizing the risk that the garment will be dislodged during high contact athletic events, are disclosed herein. It should be noted that while the exemplary embodiments described herein are associated with activewear garments for high contact athletic events (for example, Brazilian Jiu-Jitsu), the activewear garments taught below could also be equally utilized in connection with other types of indoor and outdoor activities in which a user requires or desires a garment to be secured to the area surrounding such user's face. Also, while the activewear garment taught herein is intended for use by female athletes, there is nothing that would prevent a male athlete who, for example, has religious or safety reasons for desiring to cover his hair, from wearing the activewear garments taught herein.

Referring now to FIG. 1, a perspective view of an embodiment of the activewear garment 102 worn by a user 104 is shown. In one embodiment of the activewear garment, the garment comprises a lower torso portion 106 and an upper head portion 108. The activewear garment is preferably constructed of material(s) optimized for elasticity, flexibility, and breathability. Indeed, it is contemplated that the activewear garment may be constructed of various materials and combinations of materials, including, but not limited to, synthetic and natural stretchable fabrics such as spandex, polyester, cotton and rayon lycra, stretchable nylon, stretchable silk, polyether-polyurea copolymers, among others. In one embodiment, the lower torso portion 106 and an upper head portion 108 are constructed of 92% polyester and 8% spandex blend. However, it is contemplated that alternate embodiments of the activewear garment may be constructed of a single material, or other blends of materials having different percentages. It is also contemplated that alternate embodiments may be constructed in whole, or at least partially, of fine mesh fabrics to enhance breathability of the garment. In even further alternate embodiments of the activewear garment, the garment may be at least partially constructed of material(s) having water resistant or waterproof properties such as, for example, fabrics having a Gore-Tex® waterproof and breathable fabric membrane composed of stretched polytetrafluoroethylene.

In one embodiment of the activewear garment, the lower torso portion 106 and an upper head portion 108 are joined at a neck seam 107 configured to be positioned generally adjacent to the user's neck when the activewear garment is worn. In one embodiment, the upper head portion is adapted to be worn about and secured to a user's head, a lower end of said upper head portion being attached to an upper end of said lower torso portion. In one embodiment of the activewear garment, the lower torso portion 106 and an upper head portion 108 are attached to one another by sewing the respective portions together, utilizing two different seams to attach the two portions and to enhance the structural integrity of the activewear garment. However, as those skilled in the art will appreciate, the lower torso portion 106 and an upper head portion 108 may be attached by alternate numbers of seams, depending on how great the stresses the particular garment is expected to endure during use.

Alternate embodiments of the activewear garment may also be constructed such that no neck seam is utilized, or such a seam is positioned elsewhere on the garment. In further alternate embodiments of the activewear garment, the garment may not include a lower torso portion at all, but only include an upper head portion. In even further alternate embodiments, the lower end of the upper head portion may include a strip of hook-and-loop fasteners configured to mate with a corresponding strip of hook-and-loop fasteners attached on the upper end of the lower torso portion of the activewear garment.

Still referring to FIG. 1, the upper head portion 108 of the activewear garment is configured to, when worn by a user 104, cover the user's neck, posterior of head, top of head, ears, head hair, and a substantial portion of the user's forehead. However, in alternate embodiments, the upper head portion of the activewear garment may be configured to cover more or less portions of the user's head and face than what is depicted in FIG. 1. In one embodiment of the activewear garment, the upper head portion of the garment comprises a substantially oval or circular facial opening on the anterior side of the upper head portion of the activewear garment, and is adapted and sized to allow at least a portion of a user's face to protrude from such opening.

While the facial opening of the activewear garment taught herein is described as being substantially oval or circular shaped, alternate embodiments of the activewear garment may be configured to have facial openings having various shapes. The facial opening has a circumference around the rim. As described in further detail below, a stretchable securing band 112 (or "elastic band") is attached to the inside or "interior" rim 120 of the facial opening 110 around the entire circumference of such facial opening (the term "circumference" is used herein to refer to the entire rim of the facial opening, not only with respect to generally circular facial openings, but also to facial openings having any other various shapes such as ovals and any other regular or irregular polygons). Broken lines appearing at the facial opening 110 in FIG. 1 are intended to represent stitching used to attach the elastic securing band to the interior rim 120 of the facial opening. As explained further below with reference to FIG. 2, the securing band is configured to assist in securing the facial opening and the rest of the upper head portion of the activewear garment, to the user's face and head, thereby decreasing the likelihood that that upper head portion of the garment will become dislodged during high contact athletic events.

Figure 5:
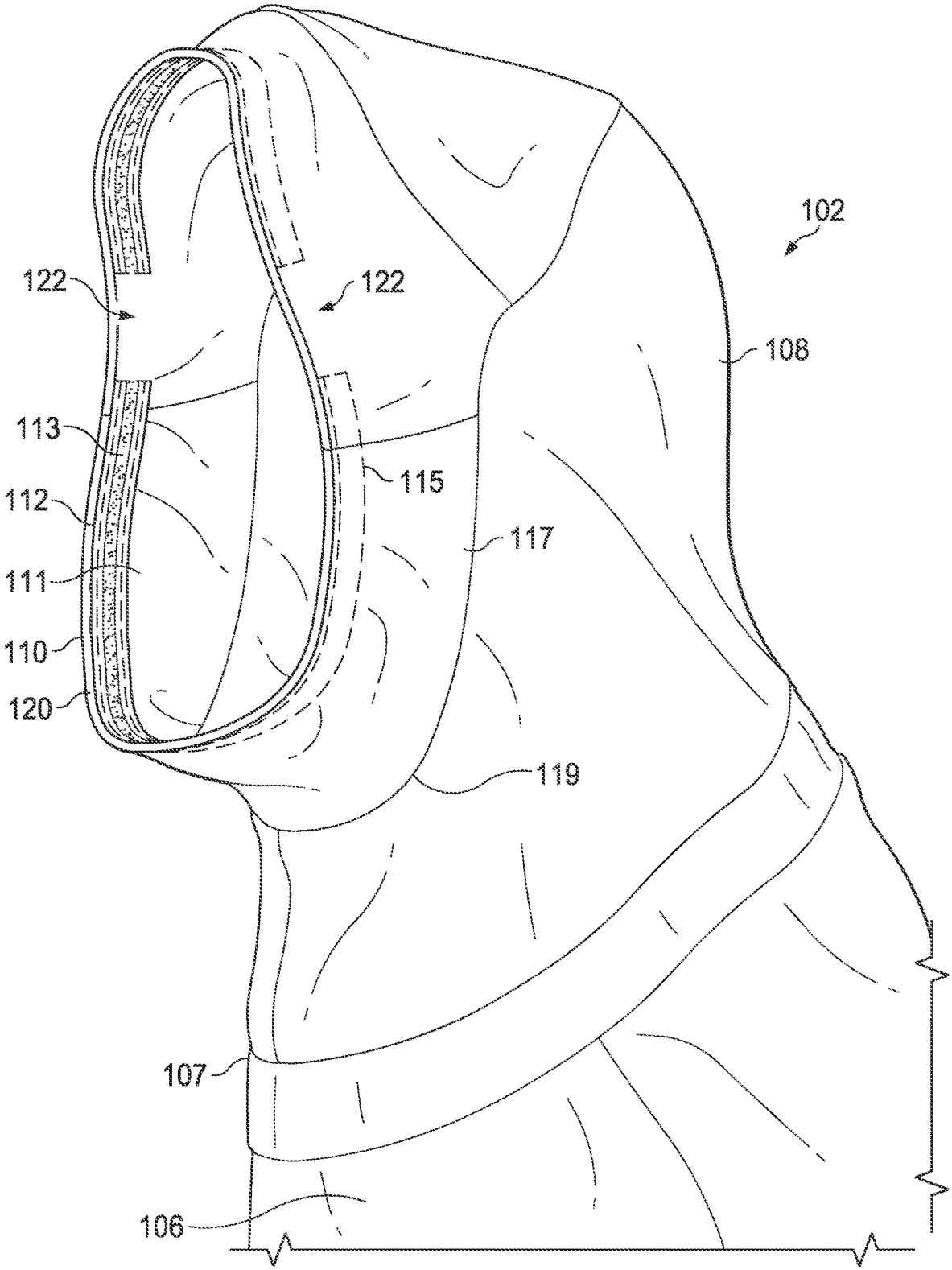
FIG. 5. is a partial side view of an alternate embodiment of the activewear garment depicted in FIG. 2.

The securing band has a first interior side (not shown) that is in contact with the interior of the facial opening, and a second exterior side that is configured to contact the user's facial skin and to carry an adhering substance applied thereto. The securing band is preferably attached around the entire circumference of the interior rim 120 of the facial opening 110, alternate embodiments of the activewear garment may be constructed such that the securing band is not a continuous band around the entire circumference of the facial opening, but rather only around portions of the facial opening. For example, it may be desirable in some alternate embodiments of the activewear garment, as depicted in FIG. 5, to have gaps 122 around the facial opening where no securing band is attached. In particular, such gaps 122 around the facial opening where no securing band is attached, may facilitate the insertion and removal of ear pods into a user's ears, or may facilitate the use of athletic glasses. In one embodiment, the elastic band includes a top portion and a bottom portion, each portion having a first end and a second end. There are first and second gaps between the respective ends of the top portion and bottom portion of the elastic band to facilitate the insertion and removal of items intended for insertion in or on a user's ears such as, for example, ear pods and athletic glasses. While such use of ear pods may not occur when the activewear garment is worn during competition, sparring, and other activities in which high contact is expected, use of the activewear garment during non-contact training activities may involve such use of ear pods in conjunction with the use of embodiments of the activewear garment. The securing band/elongate fabric elastic member comprises a top portion and a bottom portion, where said top portion has a first end and second end, wherein said bottom portion has a first end and second end, wherein said first end of said top portion is spaced apart from said first end of said bottom portion forming a first gap between the top portion ad the bottom portion, said first gap positioned adjacent to an interior rim of the facial opening, wherein said second end of said top portion is spaced apart from said second end of said bottom portion forming a second gap between the top portion and the bottom portion, said second gap positioned adjacent to said interior rim on an opposing side of said facial opening from said first gap, wherein, other than at said first gap and said second gap, said elastic member is attached to said upper head portion around an entirety of said circumference of said facial opening.

Figure 2:
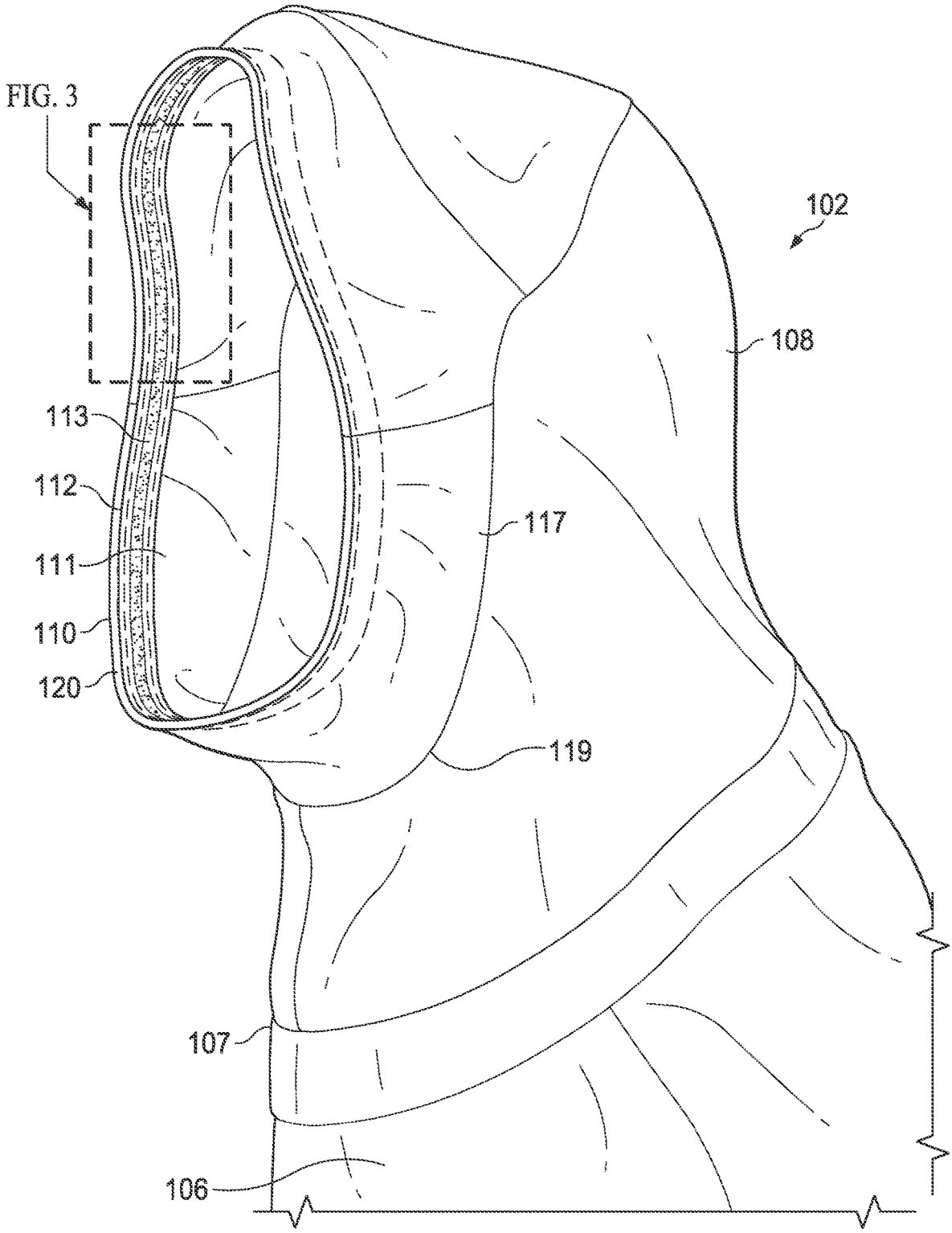
FIG. 2 is a partial side view of the embodiment of the activewear garment depicted in FIG. 1.

Referring now to FIG. 2, a partial side view of the embodiment of the activewear garment 102 depicted in FIG. 1 is shown. In one embodiment of the activewear garment, a facial extension 117 is formed on the anterior (also may be referred to as "frontal") portion of the upper head portion 108 of the activewear garment. In one embodiment, the facial extension 117 is attached to the upper head portion 108 via a stitched seam 119 encircling the facial extension. In one embodiment, the width of the extension may vary from the seam 119 to the rim 120 of the facial opening 110 by one (1) to five (5) inches, although in alternate embodiments, the extension may depart from the foregoing width range. The facial extension 117 of the activewear garment provides an advantage over prior art garment configurations in that it provides for increased coverage of the user's face. The facial extension also provides for an advantage in securing the upper head portion of the activewear garment to the user's face in that the width of the extension allows the facial opening to be secured on more vertically-inclined portions of a user's face such as the forehead, thus making the securing band able to better resist slippage and better adhere to the user's face to reduce the likelihood of dislodgment when worn by the user during high contact athletic events. The facial extension allows for the facial opening to be formed and worn well below the user's hairline, making it less likely that any adhesive substances applied to the elastic securing band will come into contact with the user's hair.

Still referring to FIG. 2, the securing band 112 is attached around the circumference of the interior rim 120 of the facial opening 110 to maximize the ability of the securing band to adhere to the user's face. The securing band 112, in the embodiment shown at FIG. 2, is attached to the inside 111 of the facial extension (at the interior rim 120 of the facial opening) via stitched threads. In one embodiment, the securing band is constructed of a woven elastic material having a synthetic or natural rubber (for example, latex) or spandex core that is wrapped in a polyester, nylon, or cotton fabric, and then woven to create the securing band. Use of a highly resistant elastic securing band is preferred as the band is intended to greatly aid in securing the upper head portion to the user's head to prevent it from becoming dislodged during high contact athletic events. An elastic band should have enough elasticity that would allow a user to protrude her face through the facial opening without undue discomfort. However, the use of an elastic band having too much elasticity, such that the band is only loosely worn on the user's face, is not ideal as it will not give the activewear garment the securing properties needed for use during high contact athletic events. It is contemplated that in alternate embodiments of the activewear garment, such garments will have elastic securing bands of various elasticity and circumference lengths, allowing users with variously sized and shaped faces and heads to select an activewear garment with suitable properties and dimensions for their unique needs.

In one embodiment, the elastic securing band comprising a woven elastic has vertical and horizontal ribbing formed on an outer surface of the elastic securing band, allowing the securing band to maintain its shape when stretched, to facilitate the attachment of the band to the activewear garment, and to provide enhanced structural elements on the band for the application of an adhering substance 113 (described below) as described further below. In other alternate embodiments of the securing band, the band may be constructed of a knit elastic or braided elastic. The use of such woven, knit, and/or braided elastics for the securing band provides an advantage over prior art garments in that such materials provide for a stronger resistance such that when the activewear garment is worn by a user, the securing band is less likely to be dislodged from the user's face during high contact activities. Also, the woven, knitted, or braided aspects of the elastic bands provides for increased surface area, increasing the ability of adhering substances 113 to stick to the exterior side of the securing band. Specifically, ribbing formed on the outer surfaces of the elastic securing member increases the surface area of the band, allowing for better application of the adhering layer onto the band.

Figure 3:
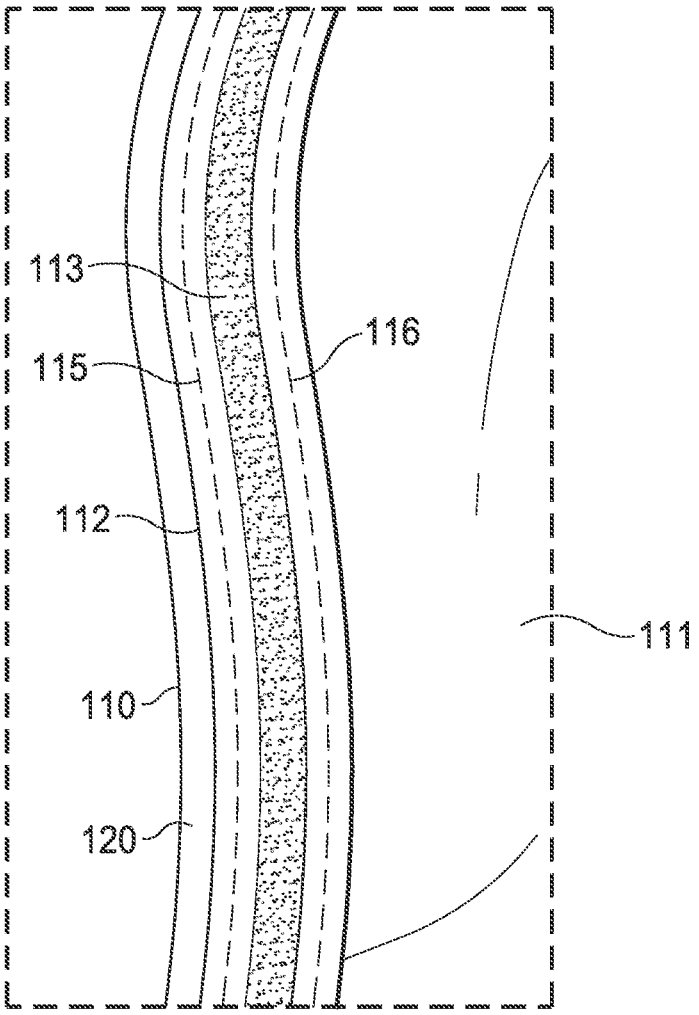
FIG. 3 is a partial view of the inside of the facial opening of the embodiment of the activewear garment as depicted in FIG. 2.

Referring now to FIG. 3, a partial view of the inside of the secure facial opening of the embodiment of the activewear garment as depicted in FIG. 2 is shown. A first interior side (not shown) of the securing band 112 is attached, via stitching (115, 116), to the interior rim of the facial opening 110. In other alternate embodiments, the securing band may be attached to the interior of the facial opening via other means such as hook-and-loop fasteners, such that one interior side of the securing band may have one of such type of hook-and-loop fasteners, and the interior rim of the facial opening may have a corresponding type of hook-and-look fastener attached thereto, allowing them to removably mate with one another.

An adhering substance is at least partially embedded or applied on/to an outer surface of the exterior side of the securing band such that the adhering substance is not easily removed, and yet also capable of adhering to the facial skin, around the interior rim of the facial opening, of a user wearing the activewear garment. The elastic core of the band (composed of, for example, rubber, spandex, and/or other elastic materials) provides elasticity such that a user's face may, with some force, can be made to protrude through the facial opening, yet also provide for enhanced resistance in securing the upper head portion to the user's face to decrease the chance of the upper head portion being dislodged during high contact athletic activities. As noted above, embodiments of the securing band constructed of an elongate fabric such as a woven, knitted, or braided elastic fabric are preferred because they involve structures (in the case of a woven elastic) such as vertical and/or horizontal ribbing that increase the surface area of the exterior of the securing band, making the application or embedding of the adhering substance more effectively adhered to the band and less likely that the adhering substance will fall off the exterior of the securing band.

Still referring to FIG. 3, the adhering substance in one embodiment is applied to or embedded in at least a central portion of the securing band to form an adhering layer on the surface of the securing band. The adhering layer is composed of one or more types of an adhering substance. The adhering substance applied to the securing band to form the adhering layer may be composed of one or more pressure sensitive adhesives which, for example, may be based on an elastomer compound with a suitable tackifier. As such pressure sensitive adhesives are preferably utilized to form the adhering layer on the securing band, no solvent, water, or heat are needed to activate the adhesive substance, but rather forms an adhesive bond, on the user's facial skin, with the application of light pressure on the band applied in the direction of the user's skin.

An example of such an adhering substance that is a pressure adhesive substance, is non-slip silicone gel, which may be applied to the woven structures (such as ribbing formed on the outer surfaces of the elastic securing band) of the securing band such that, when the band is pressed against the face of a user wearing the activewear garment, the securing band more strongly adheres to the user's face and prevents slipping of the facial opening, thereby increasing the force that would need to be applied to the garment to dislodge the garment from the user's head or even to radically shift the upper head portion about the user's head. Adhering layers composed of pressure sensitive silicone gels are preferred in that they exhibit excellent releasable adhesion to the skin and are non-toxic and hydrophobic, meaning that they are less likely to have their adhesive properties substantially reduced due to contact with a user's (or competitor's) sweat, are relatively soft, tactile, and conformable. The thickness of the adhering layer may have a thickness of between 0.5-3 mm, although such thickness may vary in alternate embodiments. Other examples of adhering substances forming the adhering layer may include other rubber/resin substances that are releasably adhesive on human skin and known to be non-toxic and non-irritants. In some embodiments, the adhering layer may be formed by an unevenly distributed application of the adhering substance on the exterior side of the elastic securing band. In other embodiments, the adhering substance may be uniformly distributed on the surface of the elastic securing band.

Figure 4:
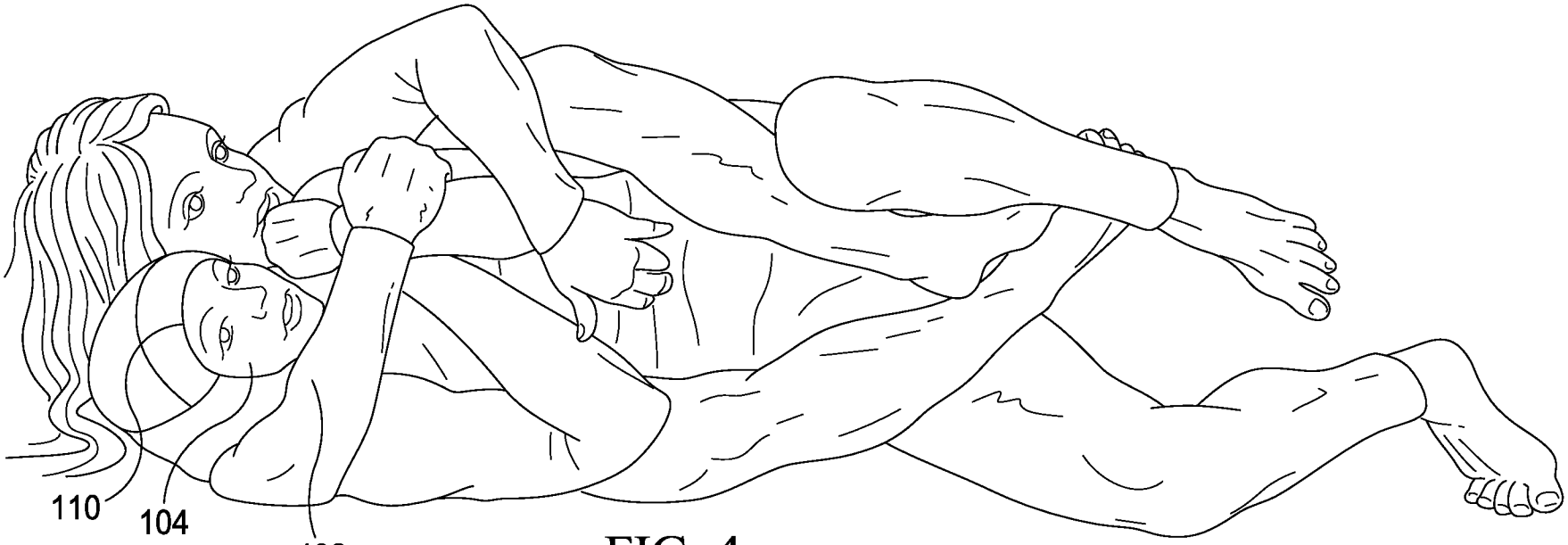
FIG. 4 is a perspective view of the embodiment of the activewear garment depicted in FIG. 1, worn by a user engagement in a high contact athletic event.

Referring now to FIG. 4, a perspective view of the embodiment of the activewear garment depicted in FIG. 1, worn by a user engagement in a high contact athletic event is shown. In many high contact athletic events such as, for example, Brazilian Jiu-Jitsu, competitors frequently grapple with one another and employ submission holds such as head-locks in which a fighter wraps his or her arm around another fighter's head. It is also very common for a fighter to grasp portions of the clothing article worn by an opposing fighter, which can cause the clothing article to shift or become dislodged. For fighters 104 wearing the activewear garment, having a facial opening with a securing band having an interior adhering layer in contact with the fighter's facial skin, provides an advantage not provided by prior art garments. Most notably, the activewear garment provides for a desired head covering while also maximizing the ability of the garment to be secured to the fighter's face and reduce the chance that the garment is fully or partially dislodged during a fight or during other high contact activity. In particular, contact by an opposing fighter 402, especially around the user's 104 face, is not likely to result in the upper head portion of the activewear garment being dislodged, which would otherwise lead to the user experiencing unwanted exposure.

The inventions may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes that come within the meaning and range of equivalency of the claims are embraced therein.

I claim:

1. An activewear garment for engaging in sporting activities comprising:

an upper head portion adapted to be worn about and secured to a user's head;

a facial opening formed on an anterior side of a facial extension of said upper head portion, said facial opening being adapted to allow a user's face to protrude, said facial opening having a circumference;

an elastic member that is attached to said upper head portion; and wherein said elastic member comprises a top portion and a bottom portion, wherein said top portion has a first end and second end, wherein said bottom portion has a first end and second end, wherein said first end of said top portion is spaced apart from said first end of said bottom portion forming a first gap between the top portion and the bottom portion, said first gap positioned adjacent to an interior rim of said facial opening, wherein said second end of said top portion is spaced apart from said second end of said bottom portion forming a second gap between the top portion and the bottom portion, said second gap positioned adjacent to said interior rim on an opposing side of said facial opening from said first gap, wherein, other than at said first gap and said second gap, said elastic member is attached to said upper head portion around an entirety of said circumference of said facial opening.

2. The activewear garment of claim 1, wherein said elastic member comprises a woven fabric.

3. The activewear garment of claim 1, wherein said elastic member comprises a braided fabric.

4. The activewear garment of claim 1, wherein said elastic member comprises a knitted fabric.

5. The activewear garment of claim 1, further comprising a lower torso portion, wherein a lower end of said upper head portion is attached to an upper end of said lower torso portion.

6. The activewear garment of claim 5, wherein a first strip of hook-and-loop fasteners are attached to said lower end of said upper head portion.

7. The activewear garment of claim 6, wherein a second strip of hook-and-loop fasteners are attached to said upper end of said lower torso portion, wherein said first strip of hook-and-loop fasteners are configured to mate with said second strip of hook-and-loop fasteners.

8. An activewear garment for engaging in sporting activities comprising:

an upper head portion adapted to be worn about and secured to a user's head;

a facial opening formed on an anterior side of a facial extension of said upper head portion, said facial opening being adapted to allow a user's face to protrude, said facial opening having a circumference;

an elongate fabric elastic member that is attached to said upper head portion; and wherein said elongate fabric elastic member comprises a top portion and a bottom portion, wherein said top portion has a first end and second end, wherein said bottom portion has a first end and second end, wherein said first end of said top portion is spaced apart from said first end of said bottom portion forming a first gap between the top portion and the bottom portion, said first gap positioned adjacent to an interior rim of said facial opening, wherein said second end of said top portion is spaced apart from said second end of said bottom portion forming a second gap between the top portion and the bottom portion, said second gap positioned adjacent to said interior rim on an opposing side of said facial opening from said first gap, wherein, other than at said first gap and said second gap, said elongate fabric elastic member is attached to said upper head portion around an entirety of said circumference of said facial opening.

9. The activewear garment of claim 8, wherein said elongate fabric elastic member comprises a woven fabric.

10. The activewear garment of claim 8, wherein said elongate fabric elastic member comprises a braided fabric.

11. The activewear garment of claim 8, wherein said elongate fabric elastic member comprises a knitted fabric.

12. The activewear garment of claim 8, further comprising a lower torso portion, wherein a lower end of said upper head portion is attached to an upper end of said lower torso portion.

13. The activewear garment of claim 12, wherein a first strip of hook-and-loop fasteners are attached to said lower end of said upper head portion.

14. The activewear garment of claim 13, wherein a second strip of hook-and-loop fasteners are attached to said upper end of said lower torso portion, wherein said first strip of hook-and-loop fasteners are configured to mate with said second strip of hook-and-loop fasteners.

* * * * *